US007476079B2

(12) United States Patent
Bartlett

(10) Patent No.: US 7,476,079 B2
(45) Date of Patent: Jan. 13, 2009

(54) LOW-NOISE HVAC BLOWER ASSEMBLY

(75) Inventor: Eric Raymond Bartlett, London (CA)

(73) Assignee: Continental Automotive Systems US, Inc., Auburn Hills ( * ) Notice: Subject to any disclaimer, the term of this patent is extended or adjusted under 35 U.S.C. 154(b) by 342 days.

(21) Appl. No.: 11/418,090

(22) Filed: May 5, 2006

(65) Prior Publication Data

US 2007/0041831 A1 Feb. 22, 2007

Related U.S. Application Data

(60) Provisional application No. 60/709,390, filed on Aug. 18, 2005.

(51) Int. Cl.
*F04D 29/44* (2006.01)

(52) U.S. Cl. ..... 415/203; 415/204; 415/206; 415/208.1; 415/212.1; 416/189; 416/192

(58) Field of Classification Search ..... 415/203, 415/204, 206, 208.3, 212.1; 416/189, 192
See application file for complete search history.

(56) References Cited

U.S. PATENT DOCUMENTS

| | | | | |
|---|---|---|---|---|
| 3,243,102 | A * | 3/1966 | McMahan | 415/208.2 |
| 3,365,122 | A * | 1/1968 | Hajec et al. | 417/423.14 |
| 4,946,348 | A * | 8/1990 | Yapp | 415/211.2 |
| 5,352,089 | A * | 10/1994 | Tokunaga et al. | 415/206 |
| 5,743,710 | A * | 4/1998 | Yapp | 415/208.2 |
| 5,813,831 | A * | 9/1998 | Matsunaga et al. | 415/173.6 |
| 6,299,409 | B1 * | 10/2001 | Matsunaga et al. | 415/206 |
| 6,604,906 | B2 * | 8/2003 | Ozeki et al. | 415/204 |
| 6,971,846 | B2 * | 12/2005 | Ochiai et al. | 415/203 |

* cited by examiner

*Primary Examiner*—Igor Kershteyn

(57) ABSTRACT

A blower assembly 10' includes a housing 18' having an inlet 19 and an outlet 20. The housing includes an inlet ring 22' at the inlet. A blower wheel 12' is mounted for rotation in the housing. An electric motor 16 includes a shaft 14 having an axis B. The shaft is coupled to the blower wheel so that rotation of the shaft causes rotation of the blower wheel that causes air to flow from the inlet to the outlet. The inlet ring has an annular extension 24 extending linearly in the same direction as the shaft axis B. An end 26 of the blower wheel 12' is within bounds of the extension 24.

12 Claims, 2 Drawing Sheets

LOW-NOISE HVAC BLOWER ASSEMBLY

This application claims the benefit of the earlier filing date of U.S. Provisional Application No. 60/709,390, filed on Aug. 18, 2005, which is incorporated by reference herein in its entirety.

FIELD OF THE INVENTION

The present invention relates generally to centrifugal blower assemblies for automotive vehicles. More particularly, the present invention relates to a centrifugal blower assembly that reduces noise and increases efficiency.

BACKGROUND OF THE INVENTION

Centrifugal blowers and fans generally include an impeller or blower wheel that rotates in a predetermined direction in a housing and is driven by an electric motor. The blower wheel has curved blades that draw air in axially along the blower wheel's axis of rotation, and discharge air radially outwardly. Such blowers are used in a variety of applications, such as in heating and cooling systems, especially for automotive applications.

FIGS. 1-3 show a conventional blower assembly, generally indicated at 10, that includes a blower wheel 12 that is coupled for rotation with a shaft 14 of an electric motor 16. The blower wheel 12 is mounted in a housing 18 and when rotated, causes air to flow from inlet 19 to outlet 20 of the housing 18.

The blower assembly 10 works well for its intended purpose, but there is a need to reduce noise of the blower assembly 10 and improve the efficiency thereof.

SUMMARY OF THE INVENTION

An object of the invention is to fulfill the need referred to above. In accordance with the principles of the present invention, this objective is obtained by providing a blower assembly including a housing having an inlet and an outlet. The housing includes an inlet ring at the inlet. A blower wheel is mounted for rotation in the housing. An electric motor includes a shaft having an axis. The shaft is coupled to the blower wheel so that rotation of the shaft causes rotation of the blower wheel which causes air to flow from the inlet to the outlet. The inlet ring has an annular extension extending generally linearly in the same direction as the shaft axis. An end of the blower wheel is within bounds of the extension. Thus, the outlet of blades of the blower wheel is more centered in the housing giving a more uniform exit velocity and preventing recirculation on the inlet side of the housing, reducing noise and increasing efficiency.

In accordance with another aspect of the invention, a method of mounting a blower wheel in a housing provides a housing having an inlet and an outlet. The housing includes an inlet ring at the inlet. The inlet ring has an annular extension. A blower wheel and an electric motor are provided with the motor including a shaft having an axis. The shaft is coupled to the blower wheel so that rotation of the shaft causes rotation of the blower wheel which causes air to flow from the inlet to the outlet. The annular extension extends generally linearly in the same direction as the shaft axis. The method includes mounting the blower wheel so that an end thereof is within the bounds of the extension.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 6:
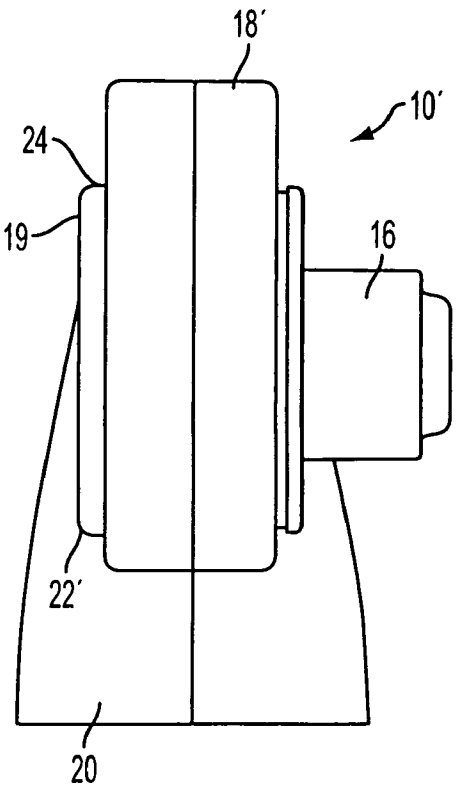
FIG. 6 is a side view of the blower assembly of FIG. 4.
Figure 5:
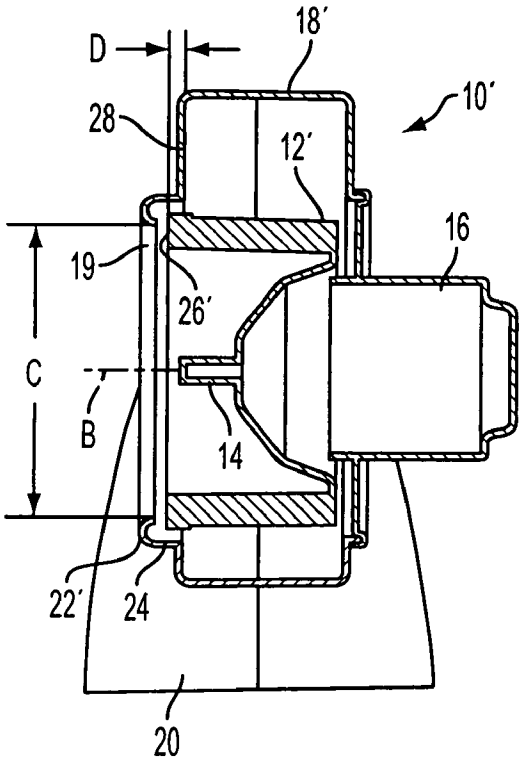
FIG. 5 is a sectional view taken along the line 5-5 of FIG. 4.
Figure 4:
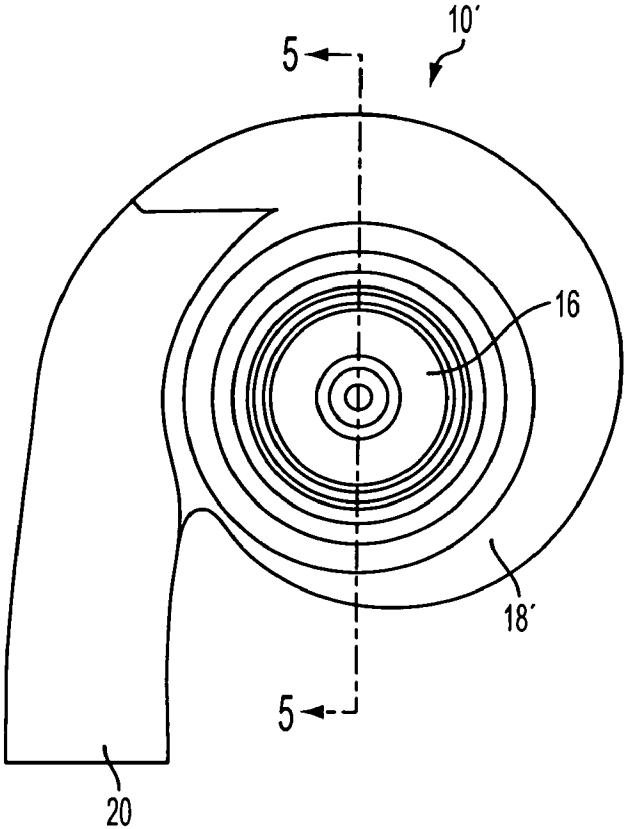
FIG. 4 is a front view of a blower assembly provided in accordance with the principles of the present invention.

With reference to FIGS. 4-6, a centrifugal blower assembly, generally indicated at 10', is shown in accordance with the principles of the present invention. The blower assembly 10' includes a blower wheel 12' that is coupled for rotation with a shaft 14 of an electric motor 16. The blower wheel 12' is mounted in a housing 18'. The blower wheel 12' has curved blades (not shown) that draw air in axially along the blower wheel's axis of rotation (axis B), and discharge air radially outwardly. Thus, rotation of the blower wheel 12' causes air to flow from inlet 19 to outlet 20 of the housing 18'. The blower assembly 10' relates to blowers for automotive applications such as, but is not limited to, engine cooling, HVAC (Heating, Ventilation and Air Conditioning).

Figure 3:
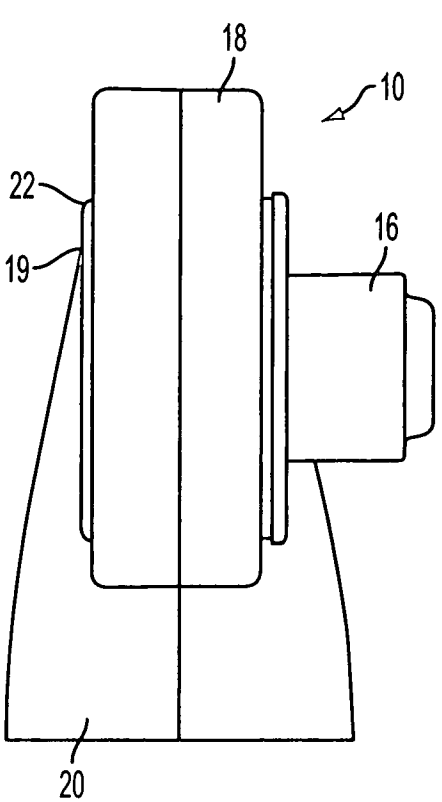
FIG. 3 PRIOR ART
FIG. 3 is a side view of the blower assembly of FIG. 1.
Figure 2:
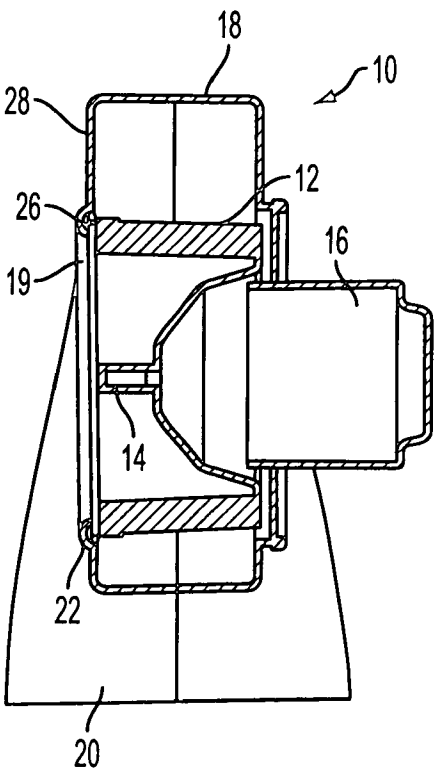
FIG. 2 PRIOR ART
FIG. 2 is a sectional view taken along the line 2-2 of FIG. 1.
Figure 1:
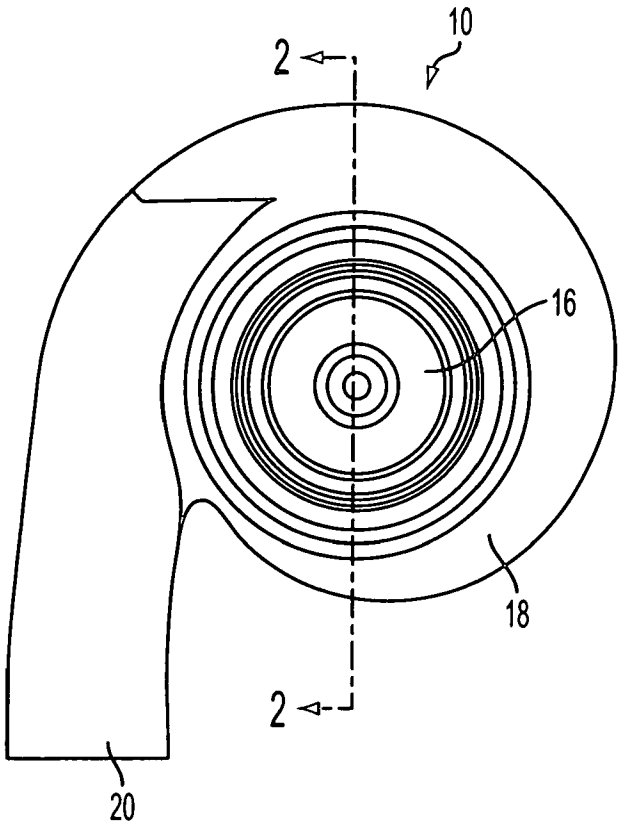
FIG. 1 PRIOR ART
FIG. 1 is a front view of a conventional blower assembly.

As compared to the inlet ring 22 of the conventional blower assembly 10 of FIG. 2, the inlet ring 22' of blower assembly 10' of FIG. 5 has an annular extension 24 that extends away from the shaft 14 (towards the left portion of FIG. 5). Thus, the extension 24 extends generally linearly in the same direction as an axis B of the shaft 14 (e.g., generally horizontally in FIG. 5). The inlet ring 22' with extension 24 defines a generally J-shape in cross-section, enabling the blower wheel 12' to be moved deeper into the inlet 19 (towards the left portion of FIG. 5 as compared to the blower wheel 12 of FIG. 2). Thus, the end 26' of the blower wheel 12' is within the bounds of the extension 24 and outside of end wall 28 of the housing 18 to which the extension 24 is joined. The setting of the blower wheel 12' deeper into the inlet 19 can be appreciated in FIG. 5 in that the end 26' extends a distance D beyond the wall 28. In FIG. 2, the end 26 of the conventional blower wheel 12 is generally flush with the end wall 28 of the housing 18. Hence, the outlet of the blades of the blower wheel 12' is more centered in the housing 18' giving a more uniform exit velocity and preventing recirculation on the inlet side of the housing 18', reducing noise and increasing efficiency. In the embodiment, the inside diameter C of the inlet ring 22' is 50% of the fan blade chord length, which is the distance between the leading and trailing edges of a fan blade which is respectively at the inside diameter and outside diameter of the blower wheel blades.

In order to achieve the above-mentioned improved results, it can be appreciated that all other parts of the blower assembly 10' need to be of good configuration as normally practiced. The blower assembly 10' is easy to manufacture because the diametral clearance between blower wheel 12' and the housing 18 is larger than in the conventional configuration, allowing more tolerance in the assembly.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A blower assembly comprising:

a housing having an inlet and an outlet, the housing including an inlet ring at the inlet, a blower wheel mounted for rotation in the housing, and an electric motor including a shaft having an axis, the shaft being coupled to the blower wheel so that rotation of the shaft causes rotation of the blower wheel which causes air to flow from the inlet to the outlet, wherein the inlet ring has an annular extension extending generally linearly in the same direction as the shaft axis, the inlet ring with the extension defining a generally J-shape in cross-section, thereby defining an arc portion and a leg coupled with the arc portion, an end of the blower wheel being within bounds of the leg and axially spaced from the arc portion so as to be outside the bounds of the arc portion.

2. The assembly of claim 1, wherein the housing has an end wall to which the extension is joined.

3. The assembly of claim 2, wherein the end of the blower wheel extends beyond an extent of the end wall.

4. The assembly of claim 1, wherein the blower wheel is constructed and arranged to draw air into the inlet generally in the direction of the shaft axis and to discharge air generally radially to the outlet.

5. The assembly of claim 1, wherein an inside diameter of the inlet ring is approximately 50% chord length of a fan blade of the blower wheel.

6. A blower assembly comprising:

a housing having an inlet and an outlet, the housing including intake means for permitting intake of air, a blower wheel mounted for rotation in the housing, and an electric motor including a shaft having an axis, the shaft being coupled to the blower wheel so that rotation of the shaft causes rotation of the blower wheel which causes air to flow from the inlet to the outlet, wherein the intake means includes an extension extending generally linearly in the same direction as the shaft axis, the intake means with the extension defining a generally J-shape in cross-section, thereby defining an arc portion and a leg coupled with the arc portion, an end of the blower wheel being within bounds of the leg and axially spaced from the arc portion so as to be outside the bounds of the arc portion.

7. The assembly of claim 6, wherein the housing has an end wall to which the extension is joined and the end of the blower wheel extends beyond an extent of the end wall.

8. The assembly of claim 6, wherein the blower wheel is constructed and arranged to draw air into the inlet generally in the direction of the shaft axis and to discharge air generally radially to the outlet.

9. The assembly of claim 6, wherein an inside diameter of the inlet ring is approximately 50% chord length of a fan blade of the blower wheel.

10. A method of mounting a blower wheel in a housing including:

providing a housing having an inlet and an outlet, the housing including an inlet ring at the inlet, the inlet ring having an annular extension, the inlet ring with the extension defining a generally J-shape in cross-section, thereby defining an arc portion and a leg coupled with the arc portion, providing a blower wheel, providing an electric motor including a shaft having an axis, the shaft being coupled to the blower wheel so that rotation of the shaft causes rotation of the blower wheel which causes air to flow from the inlet to the outlet, the annular extension extending generally linearly in the same direction as the shaft axis, and mounting the blower wheel so that an end thereof is within the bounds of the leg and axially spaced from the arc portion so as to be outside the bounds of the arc portion.

11. The method of claim 10, wherein the step of providing the housing includes providing the housing with an end wall to which the extension is joined and the mounting step includes mounting the blower wheel so that the end of the blower wheel extends beyond an extent of the end wall.

12. The method of claim 10, wherein the step of proving the housing includes ensuring that an inside diameter of the inlet ring is approximately 50% chord length of a fan blade of the blower wheel.

* * * * *